US010906199B2

(12) United States Patent
Bagley

(10) Patent No.: US 10,906,199 B2
(45) Date of Patent: Feb. 2, 2021

(54) ONION CHOPPER WITH SPIRALIZER INSERT

(71) Applicant: Progressive International Corporation, Kent, WA (US)

(72) Inventor: Justin Bagley, Kent, WA (US)

(73) Assignee: Progressive International Corporation, Seattle, WA (US)

( * ) Notice: Subject to any disclaimer, the term of this patent is extended or adjusted under 35 U.S.C. 154(b) by 0 days.

(21) Appl. No.: 16/287,033

(22) Filed: Feb. 27, 2019

(65) Prior Publication Data

US 2019/0263013 A1 Aug. 29, 2019

Related U.S. Application Data

(60) Provisional application No. 62/635,945, filed on Feb. 27, 2018.

(51) Int. Cl.

| | |
|---|---|
| ***B26D 9/00*** | (2006.01) |
| ***B26D 3/18*** | (2006.01) |
| ***B26D 3/11*** | (2006.01) |
| ***B26D 3/28*** | (2006.01) |
| *B26D 7/00* | (2006.01) |

(52) U.S. Cl.

CPC ..... *B26D 9/00* (2013.01); *B26D 3/11* (2013.01); *B26D 3/18* (2013.01); *B26D 3/185* (2013.01); *B26D 3/28* (2013.01); *B26D 3/283* (2013.01); *B26D 2003/288* (2013.01); *B26D 2007/0018* (2013.01); *B26D 2210/02* (2013.01)

(58) Field of Classification Search

CPC . B26D 9/00; B26D 3/11; B26D 3/185; B26D 3/283; B26D 2003/288; B26D 2007/0018; B26D 2210/02

USPC ..... 83/167, 857

See application file for complete search history.

(56) References Cited

U.S. PATENT DOCUMENTS

| | | | |
|---|---|---|---|
| 2,720,234 | A | 10/1955 | Fett |
| D307,532 | S | 5/1990 | Cautereels et al. |
| 5,303,472 | A | 4/1994 | Mbanugo |
| 5,692,424 | A | 12/1997 | Wallace |
| 5,704,485 | A | 1/1998 | Cautereels et al. |
| D447,019 | S | 8/2001 | Wong |
| 6,805,032 | B2 | 10/2004 | Engdahl |
| D499,615 | S | 12/2004 | Nordgren |
| 7,191,691 | B2 | 3/2007 | Kaposi |

(Continued)

FOREIGN PATENT DOCUMENTS

| | | | | |
|---|---|---|---|---|
| DE | 202009006804 U1 | | 9/2009 | |
| GB | 2553854 A | * | 3/2018 | ..... B26D 1/28 |

*Primary Examiner* — Kenneth E Peterson
*Assistant Examiner* — Nhat Chieu Q Do
(74) *Attorney, Agent, or Firm* — Lowe Graham Jones PLLC

(57) ABSTRACT

An onion chopper includes a container having a bottom and a plurality of sidewalls extending upwardly and terminating in a rim. A lid is attached to the container at a pivot location for movement between a closed position adjacent the rim and an open position pivoted away from the rim. A tray is removably supported atop the container, and defines a central opening positioned between a forward end and a rearward end. A spiralizer insert is removably attached to the tray within the central opening, the spiralizer insert having a central spindle and a blade extending radially outward from the central spindle.

10 Claims, 8 Drawing Sheets

(56) References Cited

U.S. PATENT DOCUMENTS

| | | | | |
|---|---|---|---|---|
| D546,638 | S | 7/2007 | Kaposi | |
| D548,022 | S | 8/2007 | Kaposi | |
| D548,025 | S | 8/2007 | Kaposi | |
| 7,762,169 | B2 | 7/2010 | Kaposi | |
| 7,992,476 | B2 | 8/2011 | Kaposi | |
| 8,596,192 | B2 * | 12/2013 | Hauser | B26D 3/283 99/537 |
| 9,370,278 | B1 | 6/2016 | Suquet et al. | |
| 2006/0090352 | A1 | 5/2006 | Kaposi | |
| 2014/0109743 | A1 | 4/2014 | Wong | |
| 2015/0217460 | A1 | 8/2015 | Hauser et al. | |
| 2016/0046032 | A1 * | 2/2016 | Schillheim | B26D 7/06 30/151 |
| 2016/0075043 | A1 | 3/2016 | Cotter | |
| 2018/0169883 | A1 * | 6/2018 | Repac | B26D 3/283 |
| 2019/0014948 | A1 * | 1/2019 | Cheung | B26D 3/11 |

* cited by examiner

ONION CHOPPER WITH SPIRALIZER INSERT

PRIORITY CLAIM

This application claims the benefit of U.S. provisional application No. 62/635,945 filed Feb. 27, 2018, the contents of which are incorporated by reference.

BACKGROUND OF THE INVENTION

In preparing food, it is often desirable to cut onions by slicing them in strips or chopping them into small pieces. Most commonly, this is done by using a knife. There are other specially-designed devices for chopping foods, such as shown in U.S. Pat. No. 7,191,691, which describes a container having a blade tray and a pivoting lid with a grid of projections to force the onion through the grid of blades for chopping.

The device of U.S. Pat. No. 7,191,691 is illustrated in FIGS. 1-4, labeled as prior art. An onion chopper as depicted includes a lower container 30 having a blade tray 20 which includes a grid of blades 40. A pivotally attached lid 10 includes a grid of projections 50 sized and arranged to project through the openings in the grid of blades when the lid is pivoted from an open position to a closed position, thereby forcing an onion or other food item through the blades.

The lid may include a rearward attachment feature 66 for removably attaching the lid to a pair of bosses 64, as shown in FIG. 2. In some instances, the blade tray 20 may also include a bore 62 allowing it to more readily be removed from the lower container. In addition, the lower container may have a removable bottom or base 70.

In some versions, the grid of blades may include only a series of parallel blades and the grid of projections may similarly be only a grid of parallel bars, such as shown in FIG. 3. In addition, in some versions the container may include volumetric markings on a sidewall of the container, preferably oriented to measure a volume when the container is tipped vertically, as seen in FIG. 4. One or more elastomeric feet 82 may be provided on the bottom surface of the container, to provide a non-skid grip.

While the existing onion chopper works quite well for chopping and dicing onions or other food items, it can be limited in its application to chopping and dicing functions.

SUMMARY OF THE INVENTION

An onion chopper includes a container having a bottom and a plurality of sidewalls extending upwardly from the bottom and terminating in a rim. A lid is attached to the container at a pivot location for movement between a closed position adjacent the rim and an open position pivoted away from the rim. A tray is removably supported atop the container, the tray having a rearward end positioned adjacent the pivot location when the tray is attached to the container and an opposing forward end, the tray further defining a central opening positioned between the forward end and the rearward end. A spiralizer insert is removably attached to the tray within the central opening, the spiralizer insert having a first central spindle and a first blade extending radially outward from the first central spindle.

In some versions, the spiralizer insert further comprises a first peripheral barrel, the first blade extending between the first central spindle and the peripheral barrel.

In some examples, the tray further comprises at a first recessed region at the rear portion of the central opening and the spiralizer insert further comprises a first post having an upwardly extending portion and a downwardly extending portion, a first retention tab extending rearwardly from the upwardly extending portion and a second retention tab extending rearwardly from the downwardly extending portion, whereby one of the first or the second retention tabs engages the first recessed region to retain the spiralizer insert within the central opening.

The tray may further comprise at a second recessed region at the rear portion of the central opening and the spiralizer insert further comprises a second post having an upwardly extending portion and a downwardly extending portion, a third retention tab extending rearwardly from the upwardly extending portion and a fourth retention tab extending rearwardly from the downwardly extending portion, whereby one of the third or fourth retention tabs engages the second recessed region to retain the spiralizer insert within the central opening.

In some versions, the spiralizer insert comprises an upper side and the lower side, the first central spindle, first peripheral barrel, and first blade being positioned on the upper side, the lower side having a second central spindle, a second peripheral barrel and a second blade extending between the second central spindle and the second peripheral barrel, whereby the spiralizer insert is removably attachable to the tray with either the first side oriented upwardly or the second side oriented upwardly.

The spiralizer insert may further comprise a forwardly extending tongue and the tray further comprises a bar having a channel, the tongue engaging the channel when the spiralizer insert is retained within the central opening.

In some examples, the tray further comprises a cavity adjacent the bar and defining a gap between the tongue and the cavity when the spiralizer insert is retained within the central opening.

The insert may also include a plurality of julienne blades positioned adjacent the first blade.

Preferably, a hand grip is separated from the spiralizer insert, the hand grip having a circular perimeter configured to fit within the first peripheral barrel, and further having a handle extending from a first side of the hand grip and a plurality of gripping features extending from a second side of the hand grip.

In some versions, a central flange is provided between the first recessed region and the second recessed region, a portion of the spiralizer insert resting on the central flange when the spiralizer insert is retained within the central opening.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
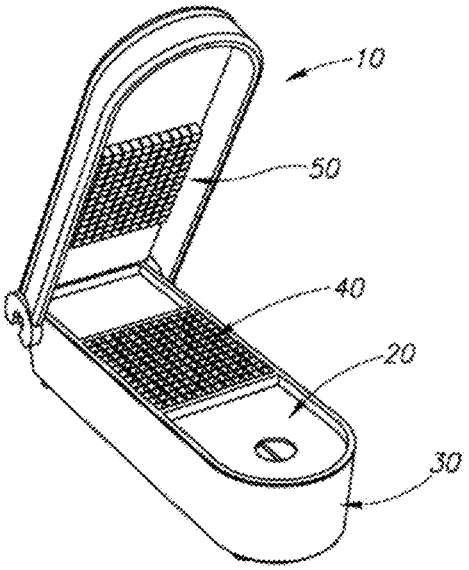
FIG. 1 (prior art)
FIG. 1 is a perspective view of a prior art onion chopper.

With further referenced to the food chopper of FIG. 1, the food chopper includes three primary components, including a lid 10, a blade tray 20, and a food reservoir or container 30. The blade tray and the container are pivotally connected to one another, with the blade tray being removably mounted atop an upper rim of the reservoir.

The lid is generally rectangular in shape, having squared corners at a first end that is pivotally connected to the reservoir and rounded corners at a second end opposite the first end. A downward-extending flange surrounds the peripheral edge of the lid, and is sized and shaped to snugly receive an outer surface of the reservoir within the flange when the lid is rotated downward against the reservoir.

Figure 2:
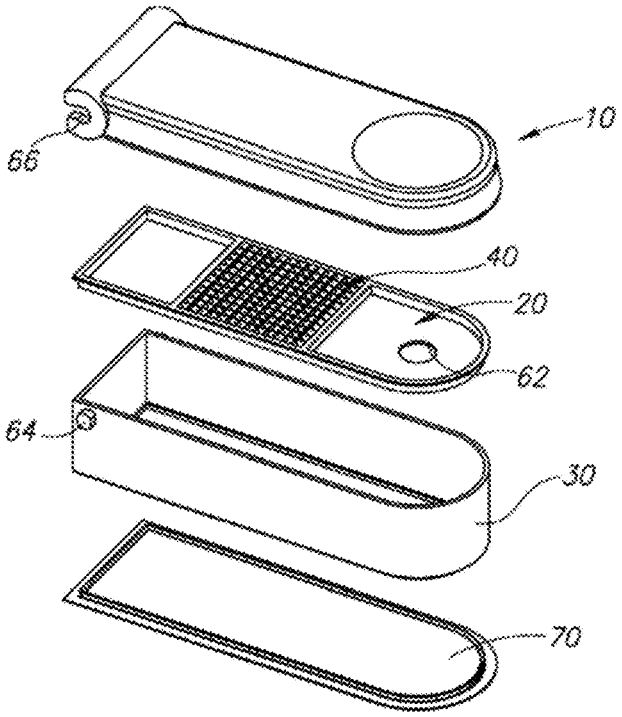
FIG. 2 (prior art)
FIG. 2 is an exploded view of a prior art onion chopper.

The reservoir includes a boss 64 at opposing sides of the squared ends of the top of the rectangular reservoir. The bosses are configured to be received within a pair of bores or openings 66 at opposite sides of the squared ends of the lid, forming the pivotal connection between the lid and the reservoir. Accordingly, the lid is able to rotate about the pivotal connection from an open position that is preferably at least about 90 degrees with respect to the blade tray to a closed position resting adjacent and substantially flush with the blade tray. The lid may be pivotally connected in other ways, and preferably is connected in a fashion that allows it to be removable. In one example, the bores 66 on the lid are open adjacent the outer edge of the lid, as shown in FIG. 2, forming a C-shape. The C-shaped openings enable the lid to more readily be removed from the tray for cleaning.

The blade tray 20 is formed in the same shape as the lid and reservoir, such that in the preferred embodiment it comprises a rectangular shape with two rounded corners. A substantially square blade grid 40 is formed at a central location on the tray. Preferably, the tray is formed from plastic and the blade grid formed from stainless steel. The top edges of the blades within the grid are sharpened in order to slice through the foods that are being pushed through the blade grid from above.

The tray includes a flat base that transitions to a generally vertical peripheral wall, as best seen in FIG. 2. At the top of the wall, the tray includes a substantially horizontal peripheral flange. The wall and flange are sized and configured such that the wall is snugly received within the side walls of the reservoir, and the flange rests against a top rim of the reservoir. In this fashion, the flange enables the tray to rest securely atop the reservoir. Alternative arrangements are also possible, including for example an internal flange or shoulder within the reservoir. Likewise, the size and shape of the tray and other components may be varied, consistent with the invention.

Each of the lid, tray, and reservoir is preferably formed from plastic, except for the blades as noted above. In a preferred form, at least the reservoir is formed from clear plastic to enable the user to see the volume of food inside.

In use, the user places an onion (or other food item) atop the grid of blades while the lid is open. By pressing against the lid, causing pivotal and downward rotation of the lid, the grid of projections is pressed against the onion. In turn, the onion is pressed against the grid of blades, urging it through the blade openings and producing chopped onion sections having a cross-sectional shape that is the same as the blade openings. Once the lid approaches the blade grid, the projections press through the grid to clear any remaining food from the grid.

When the reservoir is full, or the chopping is completed, the tray is removed from the top of the reservoir. The chopped onion or other food may then be readily removed from the reservoir. The entire device can also be easily cleaned by separating the tray from the reservoir and, if desired, also removing the lid.

Figure 3:
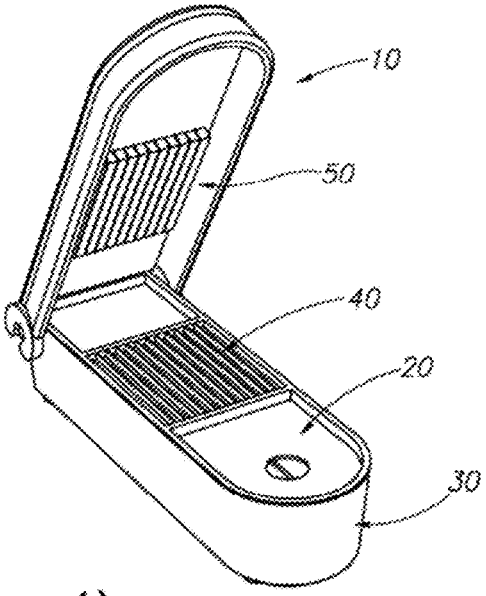
FIG. 3 (prior art)
FIG. 3 is a perspective view of an alternate prior art onion chopper.

An alternate form of the food chopping device is shown in FIG. 3. In this form, the device includes the same primary components of a lid, tray, and reservoir. The primary difference is that the grid of blades comprises a plurality of elongated parallel blades, rather than two pluralities of blades arranged at right angles. The grid of projections extending from the lid is similarly configured as a series of adjacent parallel bars that will fit snugly through the grid of blades. In addition, the reservoir is somewhat deeper and the rectangular shape is somewhat shorter, with the length and width of the rectangle being closer in length to one another.

Figure 4:
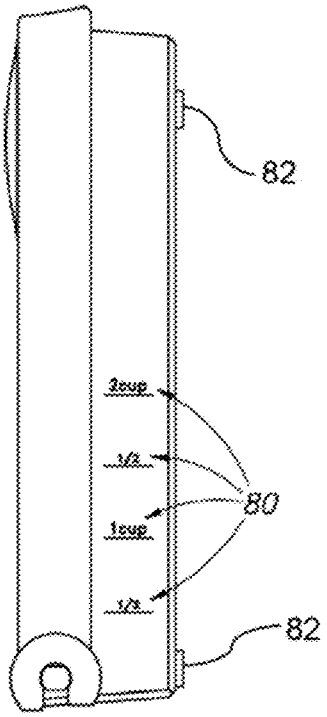
FIG. 4 (prior art)
FIG. 4 is a side elevational view of a prior art onion chopper which has been rotated vertically.

As shown in FIG. 4, the food chopping device may include measurement markings 80. In the preferred form, the measurement markings 80 are oriented vertically, so that the words are read properly with the device tipped up on end, or rotated 90 degrees. As food is chopped with the device, it will form a mound shape, making it difficult to tell with certainty the amount of food that has been chopped, even if there are measurement markings oriented horizontally. This is especially true for devices that have a base of a width or length that is substantially greater than the height. In order to determine the amount of food that has been chopped, the device is rotated 90 degrees, allowing the food to settle to the hinged end. The device may be shaken gently to allow the food to settle and form a substantially horizontal top. At that point, the user can determine the amount of chopped onions or other food ingredients by looking at the measurement markings associated with the top of the ingredient level through the clear plastic food reservoir. Ideally, the size of the reservoir is sufficient to accommodate a typically expected volume of food. In the example shown in FIG. 4, there are markings in half-cup increments up to the 2-cup level, with the reservoir itself exceeding 2 cups in volume.

As shown in FIG. 4, the volumetric markings 80 are placed on a sidewall of the reservoir. In alternate embodiments, the markings may be placed on the bottom 70, the lid 10, or in other locations that are visible and enable a determination of the volume of articles within the device.

Figure 5:
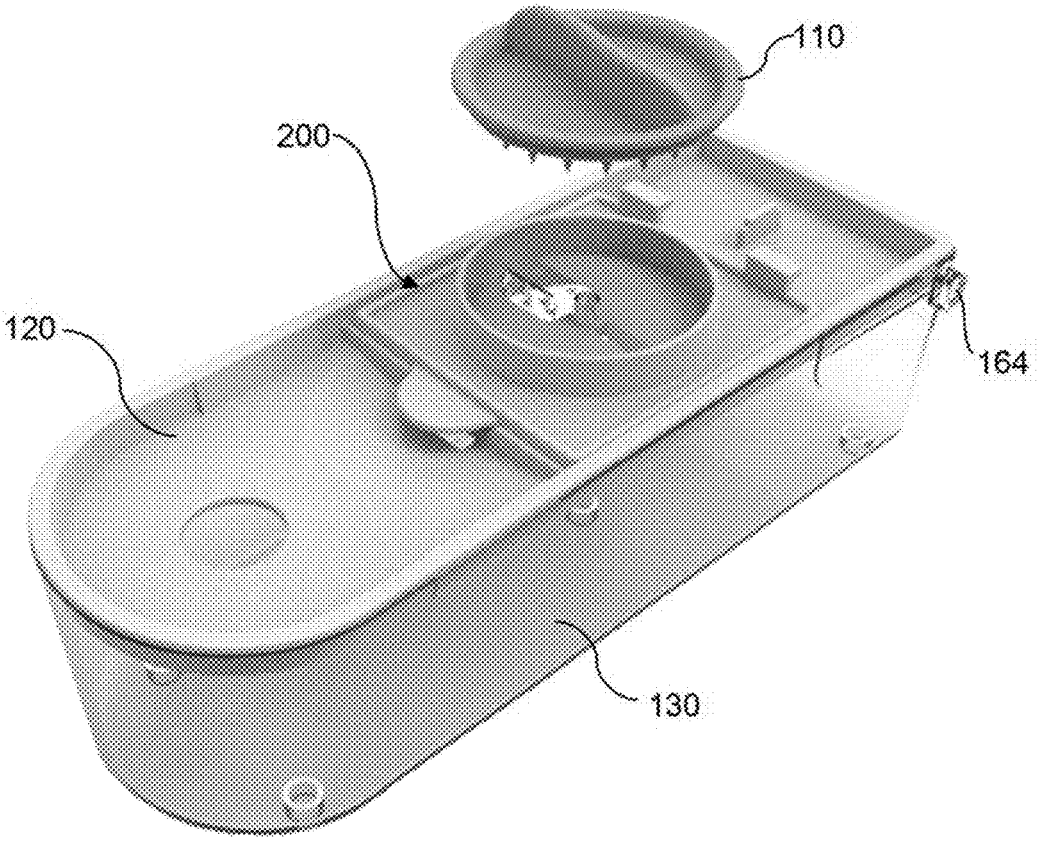
FIG. 5 is a top perspective partially exploded view of an onion chopper having a spiralizer insert.

In another version of the invention, the tray may be configured to accommodate one or more removable processing inserts, such as shown in FIG. 5 in which the tray 120 is illustrated with a preferred spiralizing insert 200. Alternatively, the spiralizing insert may be replaced with other inserts such as a grid of blades of the type described above. In the example of FIG. 5, the spiralizing insert 200 may be used with a hand grip 110 to engage an upper portion of a food item so that a user may rotate the food item safely atop the spiralizing insert for spiral cutting. In addition, the container 130 is shown with a pair of bosses 164 (only one is shown) in the same fashion as with the embodiment of FIGS. 1-4. A lid is also included, but not shown in FIG. 5 because it has been removed.

Figure 6:
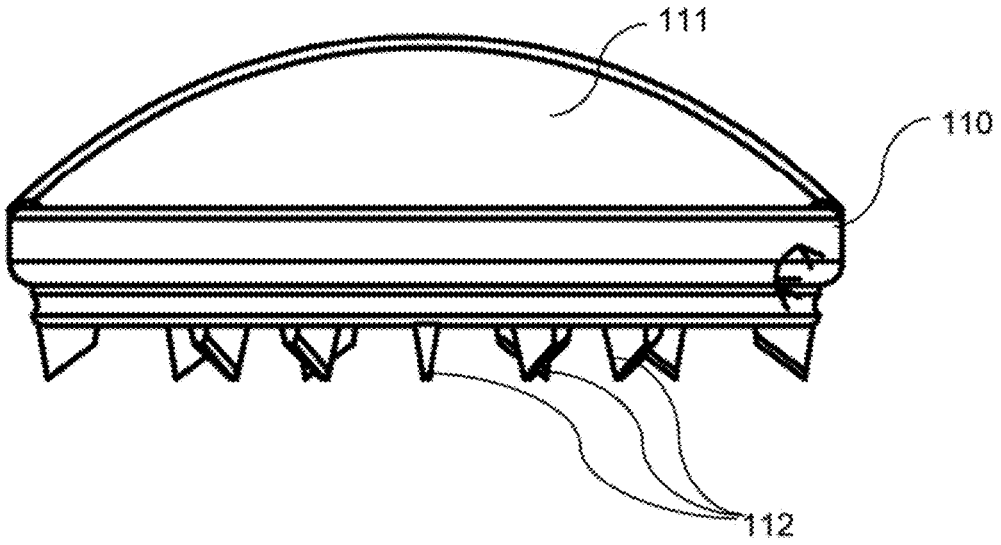
FIG. 6 is a front elevational view of a preferred hand grip for use with an onion chopper having a spiralizer insert.
Figure 7:
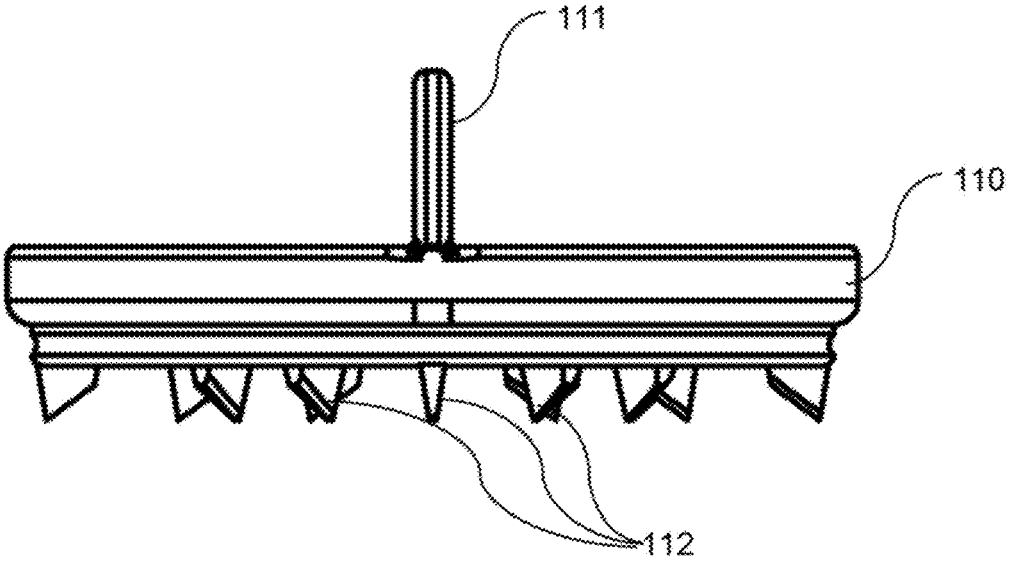
FIG. 7 is a side elevational view of a preferred hand grip for use with an onion chopper having a spiralizer insert.

An exemplary hand grip is shown in FIGS. 6 and 7, and in the illustrated example it includes an upper handle 111 formed as a vertical generally planar extension projecting upward from the horizontal base of the grip. A number of spikes 112 or fins extend downward from the base of the grip to form a gripping surface to engage a food item such as a potato carrot, apple, or other item to be sliced.

Figure 8:
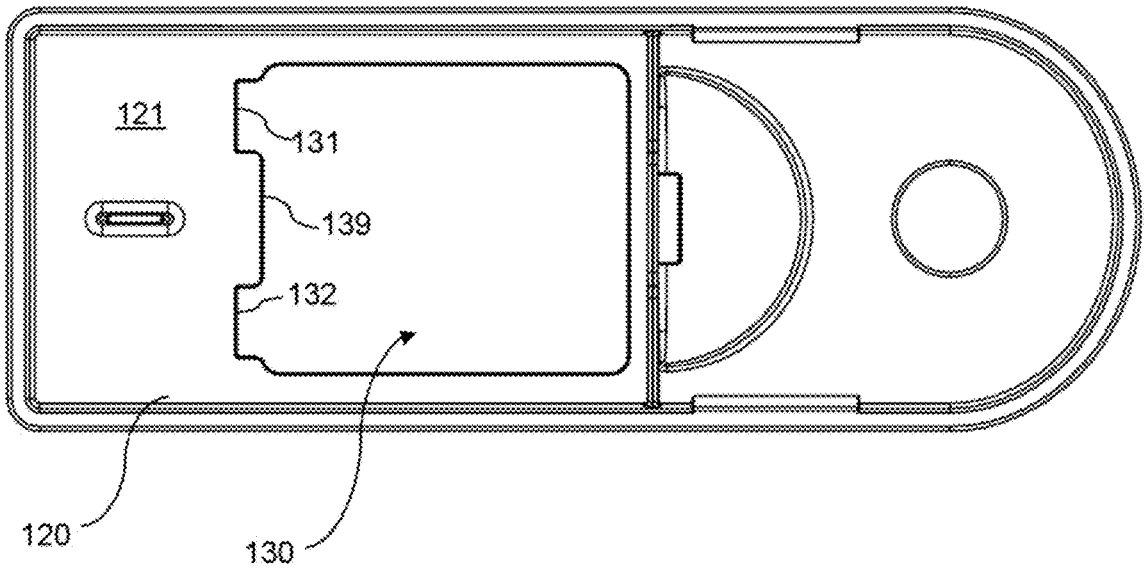
FIG. 8 is a top plan view of a tray for use with an onion chopper having a spiralizer insert.

In one version, the tray 120 (as shown in FIGS. 8-11) includes a central opening 130 to receive a removable processing insert. FIG. 8 shows a top plan view (including the upper surface 121) of an exemplary tray in which the central opening includes one or more recessed regions 131, 132 between an inwardly extending flange 139 to receive mating attachment features of a processing insert. In the illustrated example, the recessed regions are positioned at a rearward end of the tray, in which the rearward end is the end closest to the pivot bosses described above when the tray is in position supported by the rim of the container.

Figure 9:
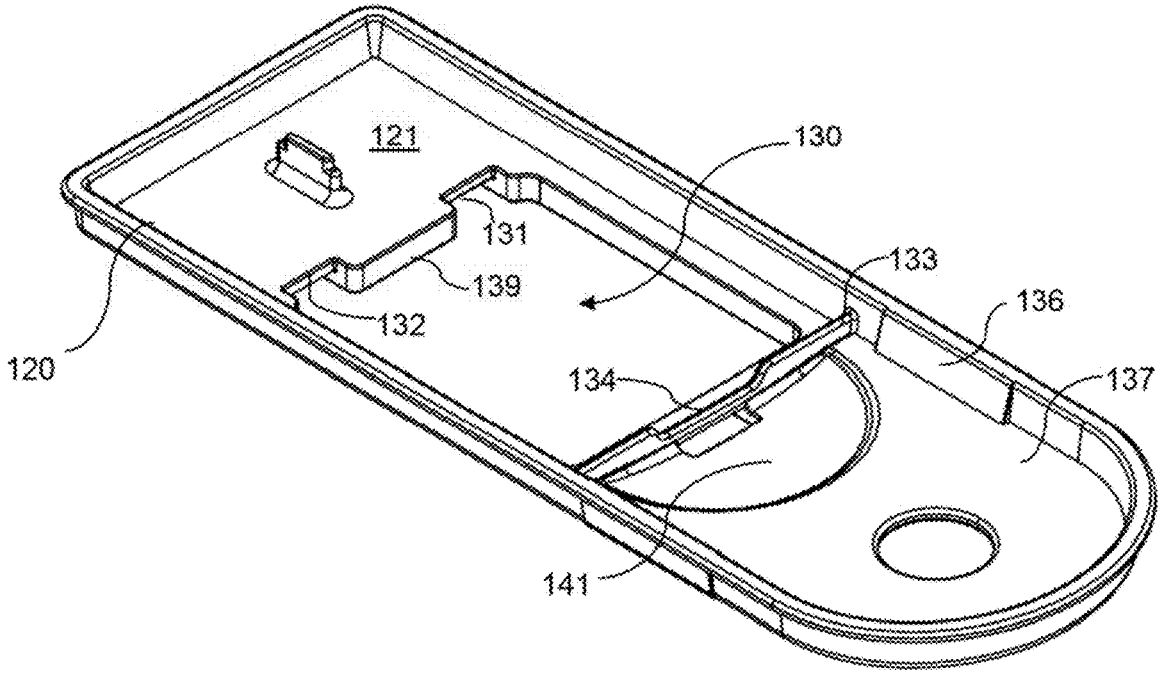
FIG. 9 is a top front perspective view of a tray for use with an onion chopper having a spiralizer insert.
Figure 10:
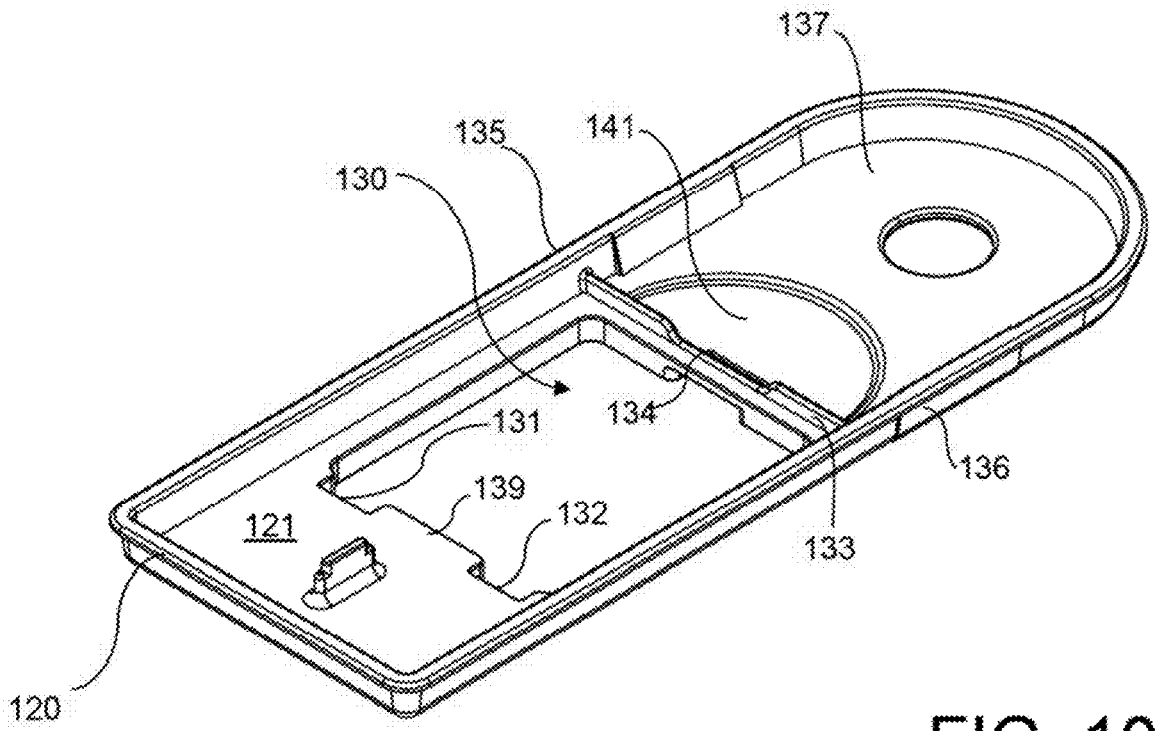
FIG. 10 is a top rear perspective view of a tray for use with an onion chopper having a spiralizer insert.
Figure 11:
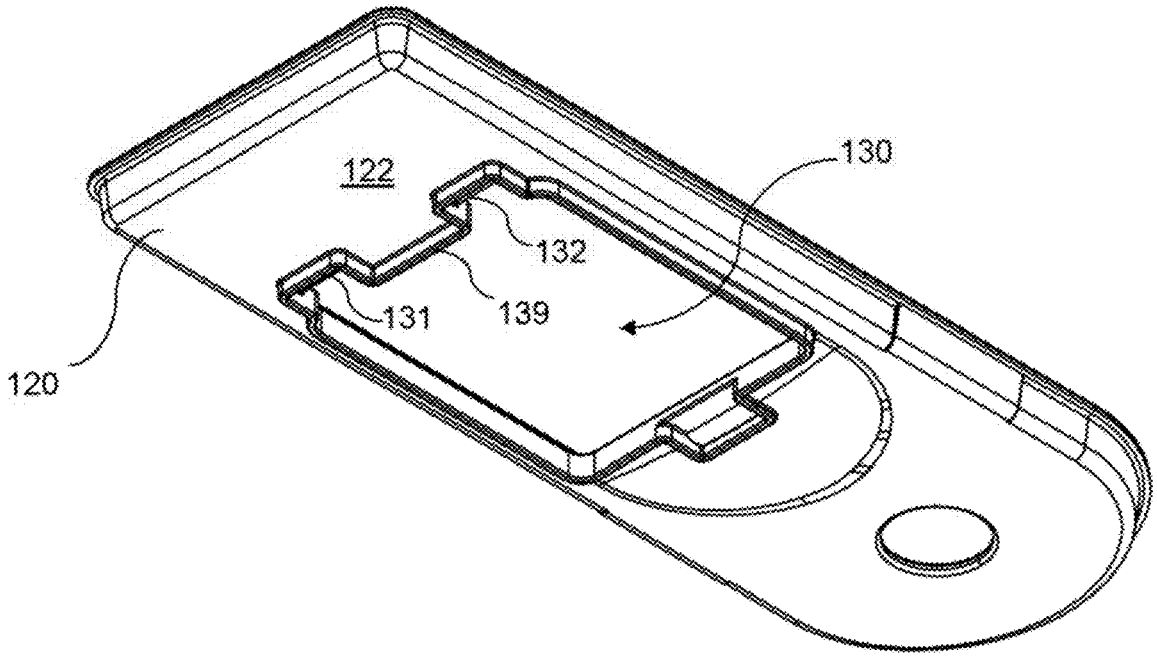
FIG. 11 is a bottom rear perspective view of a tray for use with an onion chopper having a spiralizer insert.

FIGS. 9 and 10 show top perspective views of the tray 120, including the upper surface 121. In an example version of the tray, the upper side of the tray includes a circumferential upwardly extending sidewall 136 surrounding an interior planar platform 137. A cross beam or rib 133 extends laterally from one side of the tray to the opposing side, and includes a central depression or recessed area 134. A shallow cavity 141 is positioned adjacent the recessed area of the rib, providing a slightly lowered or concave region within the otherwise planar platform.

Figure 12:
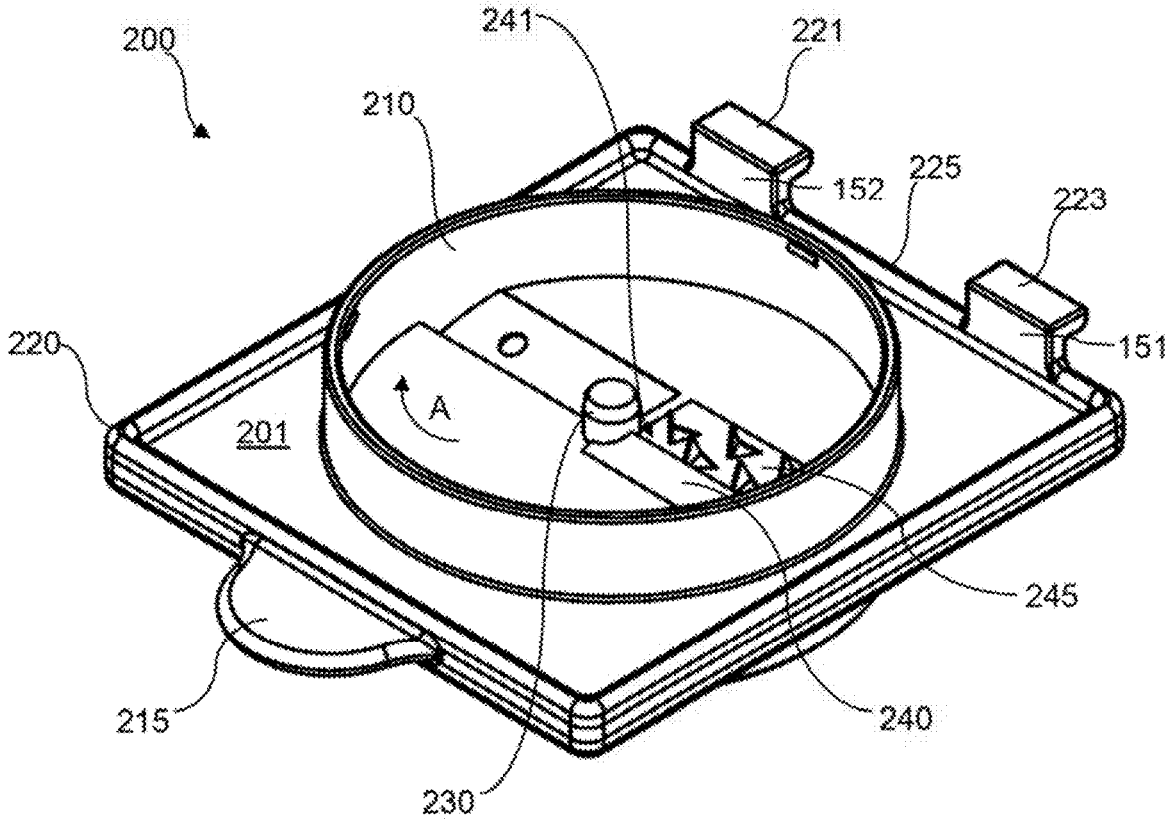
FIG. 12 is a top perspective view of a spiralizer insert for use with an onion chopper having a spiralizer insert.

A preferred spiralizing insert 200 is illustrated separately in FIGS. 12-15. In FIG. 12, a top perspective view is shown. The preferred inset is configured with a generally square perimeter 220 that is sized and shaped to fit snugly between the opposing sidewalls 135, 136 of the tray when the insert is positioned over the central opening 130 of the tray. The rearward end of the insert includes a first pair of upper retention tabs 221, 223 extending rearwardly away from the insert, and preferably above the upper surface 201 of the insert. In a preferred version the insert may be reversible and include a second pair of lower retention tabs 222, 224 extending below the lower surface 202 of the insert and also extending rearwardly as with the first pair of retention tabs.

A forward end of the insert includes a tongue 215 that extends forwardly from the perimeter 220 of the insert, in a direction opposite the retention tabs. The insert is positioned within the central opening 130 of the tray by inserting the second pair of retention tabs into the area of the recessed regions 131, 132 so they engage the lower surface 122 of the tray near the recessed regions. A central portion 225 of the insert between the retention tabs rests on the flange 139 of the tray. Each of the retention tabs projects above or below the interior portion of the inset 200 via a vertical post (e.g., 151, 152, 153).

At the forward end, the tongue is received within the channel 134 formed in the tray. In one example, the tongue is friction-fit within the channel, and further the snug fit of the insert between the tray sidewalls provides a relatively strong frictional fit of the insert within the tray. The cavity 141 at the forward end of the tray provides a gap to allow a user to insert a finger beneath the tongue to pry it up and remove the insert from the tray.

In the illustrated example, the insert is formed with a square perimeter, but it need not be square and this shape is a matter of aesthetics in addition to function. Likewise, the tongue is illustrated with a rounded shape, but may take other shapes and in this case the actual shape is chosen for a pleasing appearance.

The insert of FIGS. 12-15 is configured to produce spiral slices of a food item. In the illustrated example, it includes an upper peripheral barrel 210 extending upwardly from the upper surface 201 of the insert, positioned centrally. In the illustrated example, the barrel is configured as a short ring or sidewall, sufficient to retain a food item within the barrel and ensure that it is channeled toward a cutting blade.

A post or spindle 230 is positioned at the center of the cylindrical peripheral barrel. At one side (or the other, or both) of the spindle, a first blade 240 is positioned within the barrel and extending radially outward from the spindle to the barrel sidewall. As the first blade is configured for spiral cutting, a gap 241 is provided adjacent the sharpened edge of the blade so that food cut by the blade can pass through the gap and travel from the upper side of the insert to the lower side of the insert. Thus, in the version of FIG. 12, a food item that is mounted to the spindle 230 and rotated in a first direction (clockwise, as illustrated) such as the direction represented by the arrow A will encounter the blade 240 and be sliced, with the sliced portion traveling beneath the blade (and through the gap) to the lower side of the insert.

In the version of FIG. 12, a set of julienne blades 245 is positioned adjacent the first slicing blade 240, such that when a food item is rotated in the direction of the arrow A the food item will encounter the julienne blades before encountering the first slicing blade. Thus, in use the food item will be cut vertically by the julienne blades, then be sliced horizontally by the first slicing blade so that strips will pass through the gap between the blades and to the lower side of the insert.

In one version, the insert 200 is designed to be reversible, so that a first cutting or processing configuration is provided on the upper side of the insert while a second cutting or processing configuration is provided on the lower side of the insert. In the illustrated example, the upper side 201 of the insert includes the first slicing blade 240 and set of julienne blades 245 as discussed above, and as shown in the top plan view of FIG. 14. The lower side 202 of the insert 200 is shown in FIG. 15, illustrating a second slicing blade 250 adjacent a second gap 251 adjacent the second slicing blade. In this case, there is no set of julienne blades provided, and therefore the food item will be cut into a wide ribbon rather than into narrow strips.

Figure 13:
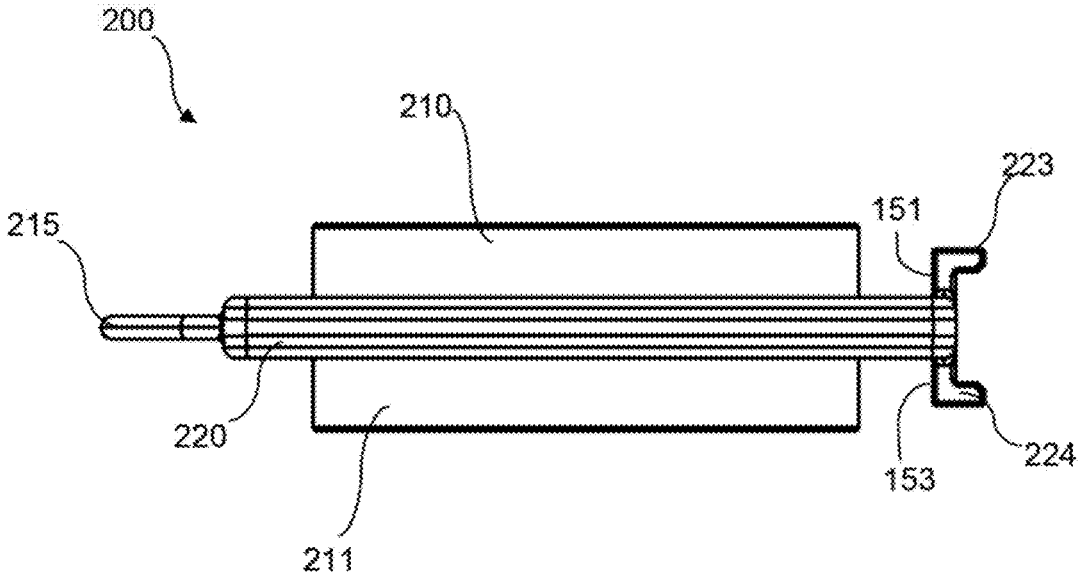
FIG. 13 is a side elevational view of a spiralizer insert for use with an onion chopper having a spiralizer insert.
Figure 14:
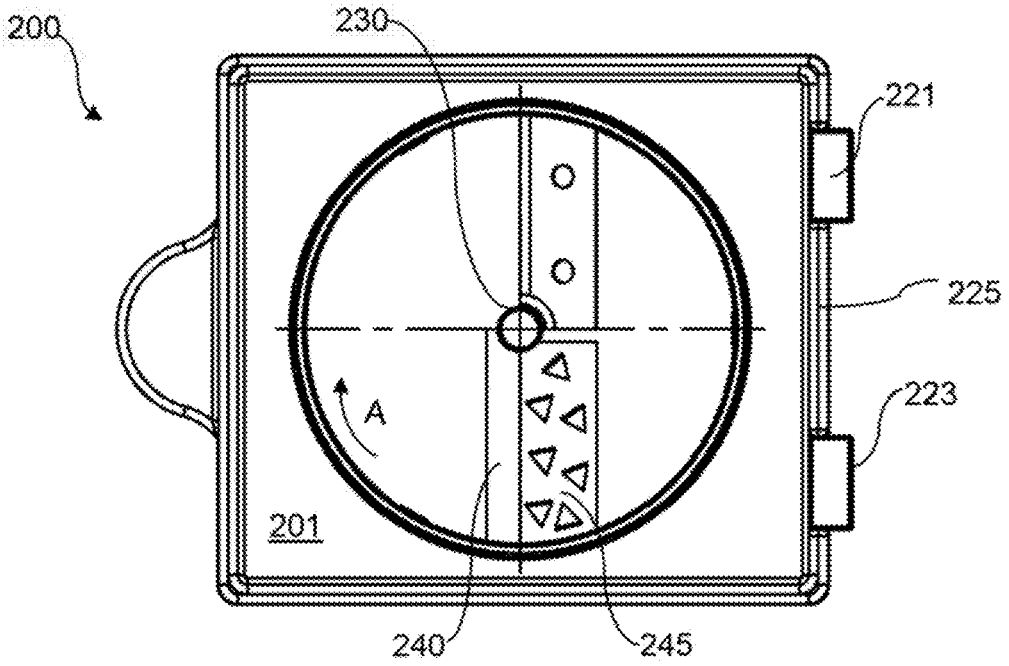
FIG. 14 is a top plan view of a spiralizer insert for use with an onion chopper having a spiralizer insert.
Figure 15:
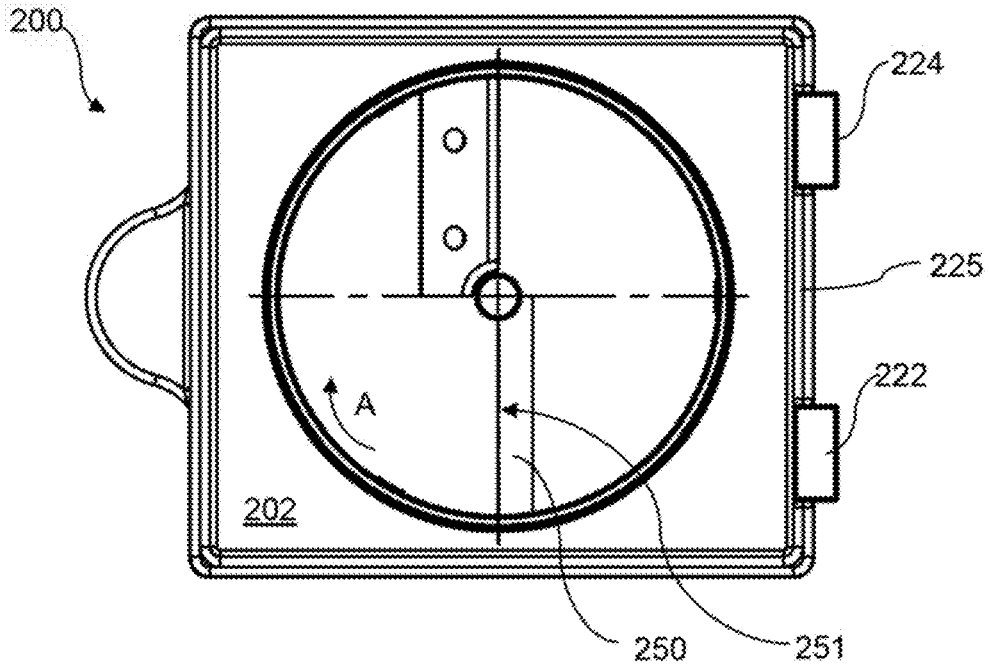
FIG. 15 is a bottom plan view of a spiralizer insert for use with an onion chopper having a spiralizer insert.

As seen in FIGS. 14 and 15, together with FIG. 13, the upper side 201 includes a first pair of retention tabs 221, 223, while the lower side includes a second pair of attachment tabs 222, 224.

In use, a user places the insert onto the tray with either the upper or lower side facing upward, depending on whether the user desires to cut a food item into strips or ribbons. The insert is attached by placing the attachment tabs into the slots or cutouts of the central opening, as described above. A food item is then pressed down onto the spindle, and the grip or hand guard is pressed down onto the food item with the user grasping the handle and pressing downward. While pressing downward, the hand guard is rotated, thereby rotating the food item at the same time. The food item encounters the blade as described above, cutting the food item into spiral strips.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims.

I claim:

1. An onion chopper, comprising:

a container having a bottom with a forward end wall, a rearward end wall, and a pair of opposing sidewalls each extending upwardly from the bottom and terminating in a rim;

a lid removably attached to the container for movement between a closed position adjacent the rim and an open position pivoted away from the rim;

a tray removably supported by the rim, the tray having a forward end positioned adjacent the forward end wall and a rearward end positioned adjacent the rearward end wall when the tray is attached to the container, the tray further defining a central opening positioned between the forward end and the rearward end; and a spiralizer insert removably attached to the tray within the central opening, the spiralizer insert having an upper first side and a lower second side;

the first side of the spiralizer insert having a first central spindle positioned within a first peripheral barrel, a first blade extending radially outward from the first central spindle toward the first peripheral barrel, and a first gap adjacent the first blade, the first gap being configured to provide a passageway from the first side to the second side;

the second side of the spiralizer insert having a second central spindle positioned within a second peripheral barrel, a second blade extending radially outward from the second central spindle toward the second peripheral barrel, and a second gap adjacent the second blade, the second gap being configured to provide a passageway from the second side to the first side, the spiralizer insert being removably attachable to the tray with either the first side oriented upwardly or the second side oriented upwardly;

the tray further having a first recessed region at the rear portion of the central opening and the spiralizer insert further having a first post having an upwardly extending portion and a downwardly extending portion, a first retention tab extending rearwardly from the upwardly extending portion and a second retention tab extending rearwardly from the downwardly extending portion, whereby one of the first or the second retention tabs engages the first recessed region to retain the spiralizer insert within the central opening;

the tray further having a second recessed region at the rear portion of the central opening and the spiralizer insert further having a second post having an upwardly extending portion and a downwardly extending portion, a third retention tab extending rearwardly from the upwardly extending portion and a fourth retention tab extending rearwardly from the downwardly extending portion, whereby one of the third or fourth retention tabs engages the second recessed region to retain the spiralizer insert within the central opening;

the spiralizer insert further having a forwardly extending tongue and the tray further having a bar having a channel, the tongue engaging the channel when the spiralizer insert is retained within the central opening;

the tray having a cavity adjacent the bar and defining a gap between the tongue and the cavity when the spiralizer insert is retained within the central opening; and a central flange between the first recessed region and the second recessed region, a portion of the spiralizer insert resting on the central flange when the spiralizer insert is retained within the central opening.

2. The onion chopper of claim 1, further comprising a plurality of julienne blades positioned adjacent the first blade.

3. The onion chopper of claim 1, further comprising a hand grip separated from the spiralizer insert, the hand grip having a circular perimeter configured to fit within the first peripheral barrel, and further having a handle extending from a first side of the hand grip and a plurality of gripping features extending from a second side of the hand grip.

4. An onion chopper, comprising:

a container having a bottom and a plurality of sidewalls extending upwardly from the bottom and terminating in a rim;

a lid attached to the container at a pivot location for movement between a closed position adjacent the rim and an open position pivoted away from the rim;

a tray removably supported atop the container, the tray having a rearward end positioned adjacent the pivot location when the tray is attached to the container and an opposing forward end, the tray further defining a central opening positioned between the forward end and the rearward end;

a spiralizer insert removably attached to the tray within the central opening, the spiralizer insert having a first central spindle and a first blade extending radially outward from the first central spindle;

the tray further having a first recessed region at the rear portion of the central opening and the spiralizer insert further comprises a first post having an upwardly extending portion and a downwardly extending portion, a first retention tab extending rearwardly from the upwardly extending portion and a second retention tab extending rearwardly from the downwardly extending portion, whereby one of the first or the second retention tabs engages the first recessed region to retain the spiralizer insert within the central opening;

the tray further having a second recessed region at the rear portion of the central opening and the spiralizer insert further comprises a second post having an upwardly extending portion and a downwardly extending portion, a third retention tab extending rearwardly from the upwardly extending portion and a fourth retention tab extending rearwardly from the downwardly extending portion, whereby one of the third or fourth retention tabs engages the second recessed region to retain the spiralizer insert within the central opening; and a central flange between the first recessed region and the second recessed region, a portion of the spiralizer insert resting on the central flange when the spiralizer insert is retained within the central opening.

5. The onion chopper of claim 4, wherein the spiralizer insert further comprises a first peripheral barrel, the first blade extending between the first central spindle and the peripheral barrel.

6. The onion chopper of claim 5, wherein the spiralizer insert further comprises a first side and a second side, the first central spindle, the first peripheral barrel, and the first blade being positioned on the first side, the second side having a second central spindle, a second peripheral barrel and a second blade extending between the second central spindle and the second peripheral barrel, whereby the spiralizer insert is removably attachable to the tray with either the first side oriented upwardly or the second side oriented upwardly.

7. The onion chopper of claim 5, wherein the spiralizer insert further comprises a forwardly extending tongue and the tray further comprises a bar having a channel, the tongue engaging the channel when the spiralizer insert is retained within the central opening.

8. The onion chopper of claim 5, wherein the tray further comprises a cavity adjacent the bar and defining a gap between the tongue and the cavity when the spiralizer insert is retained within the central opening.

9. The onion chopper of claim 5, further comprising a plurality of julienne blades positioned adjacent the first blade.

10. The onion chopper of claim 5, further comprising a hand grip separated from the spiralizer insert, the hand grip having a circular perimeter configured to fit within the first peripheral barrel, and further having a handle extending from a first side of the hand grip and a plurality of gripping features extending from a second side of the hand grip.

* * * * *